US008821058B2

(12) United States Patent
Walker et al.

(10) Patent No.: US 8,821,058 B2
(45) Date of Patent: Sep. 2, 2014

(54) PAINT APPLICATOR

(75) Inventors: Andrew Walker, Durham (GB); Daniel Bone, Durham (GB); Jonathan Armstrong, Durham (GB)

(73) Assignee: Black & Decker Inc., Newark, DE (US)

( * ) Notice: Subject to any disclaimer, the term of this patent is extended or adjusted under 35 U.S.C. 154(b) by 807 days.

(21) Appl. No.: 13/039,558

(22) Filed: Mar. 3, 2011

(65) Prior Publication Data

US 2012/0087709 A1 Apr. 12, 2012

(30) Foreign Application Priority Data

Oct. 6, 2010 (GB) ..... 1016817.7

(51) Int. Cl.
*B43M 11/02* (2006.01)

(52) U.S. Cl.
USPC ..... 401/219; 401/138; 401/179; 401/203

(58) Field of Classification Search
CPC .... B43K 23/001; B43K 23/002; A47L 13/22; A47L 13/23; A46B 11/002; A46B 11/0024; A46B 11/0037; A46B 11/06; B05C 17/035; B05C 17/0316; B05C 17/0325; B05C 17/025
USPC ..... 401/131, 138, 139, 140, 176, 179, 197, 401/203, 207, 219
See application file for complete search history.

(56) References Cited

U.S. PATENT DOCUMENTS

| | | | |
|---|---|---|---|
| 2,025,895 | A | 12/1935 | Praeger |
| 2,325,867 | A | 8/1943 | Matsakas |
| 2,357,763 | A | 9/1944 | Pratt |
| 2,443,981 | A | 6/1948 | Funk et al. |
| 2,584,724 | A | 2/1952 | Mattie |
| 2,636,252 | A | 4/1953 | Barnes et al. |
| 2,669,742 | A | 2/1954 | Coughlan |
| 2,677,839 | A | 5/1954 | Dean |
| 2,708,763 | A | 5/1955 | Jacoby |
| 2,722,029 | A | 11/1955 | Barnes et al. |
| 2,751,618 | A | 6/1956 | Pruitt |
| 2,916,755 | A | 12/1959 | Bozzay |
| 2,955,310 | A | 10/1960 | Wichern |
| 2,964,769 | A | 12/1960 | Mercereau |
| 3,094,770 | A | 6/1963 | Williams |
| 3,099,034 | A | 7/1963 | Leland |
| 3,135,005 | A | 6/1964 | Karkut |
| 3,193,868 | A | 7/1965 | Cassidy |
| 3,273,192 | A | 9/1966 | Mazzella |
| 3,320,630 | A | 5/1967 | Furlong |
| 3,321,795 | A | 5/1967 | Richardson |

(Continued)

FOREIGN PATENT DOCUMENTS

| | | |
|---|---|---|
| DE | 3325759 | 2/1985 |
| DE | 3713181 | 5/1987 |

(Continued)

*Primary Examiner* — David Walczak
(74) *Attorney, Agent, or Firm* — Stephen R. Valancius

(57) ABSTRACT

A paint applicator including an applicator head for carrying an applicator attachment, a substantially rigid elongate support having a hollow interior for supplying paint to the applicator head, a pivot mechanism interconnecting the elongate support and the applicator head, and a flexible conduit interconnecting the hollow interior of the elongate support and the applicator head. The pivot mechanism includes a detent arranged such that it releasably secures the applicator head in any of a plurality of discrete preset orientations with respect to the elongate support.

18 Claims, 10 Drawing Sheets

(56) References Cited

U.S. PATENT DOCUMENTS

| | | | | |
|---|---|---|---|---|
| 3,337,899 | A | 8/1967 | Rentfrow | |
| 3,408,676 | A | 11/1968 | Cayo | |
| 3,419,931 | A | 1/1969 | Willig | |
| 3,441,355 | A | 4/1969 | Brown | |
| 3,554,659 | A | 1/1971 | Stokes | |
| 3,612,707 | A | 10/1971 | Herbrechter | |
| 3,622,246 | A | 11/1971 | Grooms | |
| 3,685,084 | A | 8/1972 | Bennett | |
| 3,702,739 | A | 11/1972 | Rentfrow | |
| 3,751,748 | A | 8/1973 | Roe et al. | |
| 3,776,645 | A | 12/1973 | Walker | |
| 3,809,484 | A | 5/1974 | Bradshaw | |
| 3,850,532 | A | 11/1974 | Kaiser | |
| 3,866,257 | A | 2/1975 | Cansdale, Sr. | |
| 3,877,823 | A | 4/1975 | Leland | |
| 3,937,583 | A | 2/1976 | Tyson et al. | |
| 4,032,238 | A | 6/1977 | Leland | |
| RE29,311 | E | 7/1977 | Ritter | |
| 4,140,410 | A | 2/1979 | Garcia | |
| 4,175,300 | A | 11/1979 | McGlew et al. | |
| 4,196,491 | A | 4/1980 | Baril | |
| 4,222,678 | A | 9/1980 | Miller | |
| 4,231,668 | A | 11/1980 | Groth et al. | |
| 4,316,301 | A | 2/1982 | Smith et al. | |
| 4,390,115 | A | 6/1983 | Bigham | |
| 4,422,788 | A | 12/1983 | Braithwaite et al. | |
| 4,422,789 | A | 12/1983 | Charney et al. | |
| 4,467,509 | A | 8/1984 | Dezen | |
| 4,528,714 | A | 7/1985 | Beck | |
| 4,541,140 | A | 9/1985 | Allison | |
| 4,552,477 | A | 11/1985 | Braithwaite et al. | |
| 4,566,816 | A | 1/1986 | Janssen | |
| 4,639,156 | A | 1/1987 | Stern et al. | |
| 4,695,176 | A | 9/1987 | Simonette et al. | |
| 4,728,213 | A | 3/1988 | Geberth, Jr. | |
| 4,732,503 | A | 3/1988 | Bader et al. | |
| 4,735,522 | A | 4/1988 | Myun-Sik | |
| 4,810,123 | A | 3/1989 | Bruggeman | |
| 4,897,893 | A | 2/1990 | Barker | |
| 4,985,959 | A | 1/1991 | Lieberman et al. | |
| 4,997,302 | A | 3/1991 | Simonette | |
| 5,050,261 | A | 9/1991 | Hofacker | |
| 5,123,768 | A | 6/1992 | Franklin | |
| 5,207,755 | A | 5/1993 | Ampian | |
| 5,246,650 | A | 9/1993 | Clark | |
| 5,269,039 | A | 12/1993 | Isaac | |
| 5,288,161 | A | 2/1994 | Graves et al. | |
| 5,401,231 | A | 3/1995 | Hebert | |
| 5,419,003 | A | 5/1995 | Tollasepp | |
| 5,454,656 | A | 10/1995 | Rowe | |
| 5,496,123 | A * | 3/1996 | Gaither | 401/176 |
| 5,579,558 | A | 12/1996 | Newman, Jr. et al. | |
| 5,595,451 | A | 1/1997 | Harrison, Jr. | |
| 5,624,260 | A | 4/1997 | Wilcox et al. | |
| 5,682,641 | A | 11/1997 | Newman, Jr. et al. | |
| 5,711,047 | A | 1/1998 | Armaly, Jr. | |
| 5,755,004 | A | 5/1998 | Miller | |
| 5,755,362 | A | 5/1998 | Rodriguez, Jr. et al. | |
| 5,860,902 | A | 1/1999 | Jang et al. | |
| 5,903,952 | A | 5/1999 | Camp, Jr. et al. | |
| 5,975,782 | A | 11/1999 | Lee | |
| D417,552 | S | 12/1999 | Snetting et al. | |
| 6,099,186 | A | 8/2000 | Lye | |
| 6,109,809 | A | 8/2000 | Pistis | |
| 6,142,693 | A | 11/2000 | Bruggeman et al. | |
| 6,175,985 | B1 | 1/2001 | Chambers et al. | |
| 6,206,599 | B1 | 3/2001 | Buchanan et al. | |
| 6,244,771 | B1 | 6/2001 | Bruggeman et al. | |
| 6,378,158 | B1 | 4/2002 | Bukovitz | |
| 6,387,977 | B1 | 5/2002 | Sawhney et al. | |
| 6,408,479 | B1 | 6/2002 | Pinney | |
| 6,546,596 | B2 | 4/2003 | Grote et al. | |
| 6,655,746 | B1 | 12/2003 | Weihrauch | |
| 6,688,367 | B1 | 2/2004 | Ruposky et al. | |
| 6,701,975 | B1 | 3/2004 | Neal | |
| 6,702,727 | B2 | 3/2004 | Karsten | |
| 6,726,389 | B1 | 4/2004 | Lee | |
| 6,789,973 | B2 | 9/2004 | Marks | |
| 6,851,155 | B2 | 2/2005 | Dove | |
| 6,874,201 | B2 | 4/2005 | Ta et al. | |
| 6,877,925 | B2 | 4/2005 | Fernandez | |
| 6,922,866 | B2 | 8/2005 | Er | |
| 6,925,686 | B2 | 8/2005 | Heathcock et al. | |
| 6,928,689 | B2 | 8/2005 | Dove | |
| 7,124,474 | B2 | 10/2006 | Nicolay et al. | |
| 7,174,597 | B2 | 2/2007 | Bruggeman | |
| 7,255,509 | B2 | 8/2007 | Wang | |
| 7,407,336 | B2 | 8/2008 | Giacomo | |
| 7,549,195 | B2 | 6/2009 | Bensussan et al. | |
| 7,556,447 | B2 | 7/2009 | Bruggeman et al. | |
| 7,682,098 | B2 * | 3/2010 | Sandahl et al. | 401/170 |
| 7,857,781 | B2 | 12/2010 | Noda et al. | |
| 8,596,597 | B1 * | 12/2013 | Spicer | 248/351 |
| 2001/0036513 | A1 | 11/2001 | Capoccia | |
| 2002/0020349 | A1 | 2/2002 | Woodnorth et al. | |
| 2002/0028103 | A1 | 3/2002 | Frank et al. | |
| 2002/0042331 | A1 | 4/2002 | Fortner et al. | |
| 2003/0074758 | A1 | 4/2003 | Mitchell | |
| 2003/0213084 | A1 | 11/2003 | Mitchell | |
| 2003/0224121 | A1 | 12/2003 | Karroll | |
| 2004/0154119 | A1 | 8/2004 | Bullock | |
| 2005/0034261 | A1 | 2/2005 | Capoccia | |
| 2005/0050665 | A1 | 3/2005 | Mitchell | |
| 2005/0226680 | A1 | 10/2005 | Lawrence | |
| 2006/0120794 | A1 | 6/2006 | Scott et al. | |
| 2006/0130261 | A1 | 6/2006 | Futo et al. | |
| 2006/0130262 | A1 | 6/2006 | Visk et al. | |
| 2007/0110505 | A1 | 5/2007 | Frank et al. | |
| 2007/0217856 | A1 | 9/2007 | Kott et al. | |
| 2008/0131193 | A1 | 6/2008 | Botero et al. | |
| 2008/0193196 | A1 | 8/2008 | Sandahl et al. | |
| 2008/0247808 | A1 | 10/2008 | Costigan | |
| 2009/0070943 | A1 | 3/2009 | Smith et al. | |
| 2009/0080964 | A1 | 3/2009 | Castellana | |
| 2009/0089952 | A1 | 4/2009 | Smith et al. | |

FOREIGN PATENT DOCUMENTS

| | | |
|---|---|---|
| DE | 3903519 | 8/1990 |
| DE | 4135068 | 5/1993 |
| DE | 19912546 | 9/2000 |
| DE | 20201452 | 5/2002 |
| DE | 102004049304 | 6/2006 |
| EP | 0769330 | 4/1997 |
| FR | 2556245 | 6/1985 |
| JP | 51143046 | 11/1976 |
| WO | WO 97/37773 | 10/1997 |
| WO | WO2009/088539 | 7/2009 |

* cited by examiner

PAINT APPLICATOR

BACKGROUND OF THE INVENTION

The present invention relates to paint applicators. The invention has particular relevance to paint applicators in the form of paint rollers, but it also has relevance to other types of applicators, for example pad or sponge applicators. Additionally, the applicators according to the invention may generally be used to apply other coating materials, for example stains, inks, preservers, and the like, and the term "paint" as used herein is intended to include such coating materials, and similar coating materials.

SUMMARY OF THE INVENTION

The invention seeks to provide an improved paint applicator. A first aspect of the invention provides a paint applicator, comprising:

(a) an applicator head for carrying an applicator attachment;

(b) a substantially rigid elongate support having a hollow interior for supplying paint to the applicator head;

(c) a pivot mechanism interconnecting the elongate support and the applicator head; and (d) a flexible conduit interconnecting the hollow interior of the elongate support and the applicator head;

wherein the pivot mechanism includes a detent arranged such that it releasably secures the applicator head in any of a plurality of discrete preset orientations with respect to the elongate support.

In some embodiments of the invention, the applicator attachment is a roller applicator, but other types of applicator may be used, for example a pad or a sponge. For embodiments in which the applicator attachment is a roller applicator, the applicator head may comprise a hollow tubular support on which the applicator attachment may be rotatably mounted. The applicator head may include one or more (preferably a plurality of) apertures interconnecting the interior thereof with the applicator attachment, to supply paint to the applicator attachment.

The pivot mechanism may comprise first and second corresponding profiles, and the detent may comprise a profile arranged to engage with both the first and second profiles to prevent their rotation with respect to each other, thereby securing the applicator head in a said discrete preset orientation with respect to the elongate support. The detent may be arranged to allow the applicator head to be released from said discrete preset orientation with respect to the elongate support by being movable, for example along the axis of rotation of the first and second profiles, out of engagement with at least one of the first and second profiles. The detent is resiliently biased, for example by means of a spring, to engage with both the first and second profiles. The movement of the detent out of engagement with at least one of the first and second profiles may need to be against the resilient bias.

The first and second profiles may, for example, each comprise a plurality of circumferentially arranged protrusions and recesses (i.e. circumferentially around their axis of rotation). The discrete preset orientations of the applicator head with respect to the elongate support may correspond to relative orientations of the first and second profiles in which their respective protrusions and their respective recesses are substantially aligned. The detent may, for example, comprise one or more protrusions, but may comprise a plurality of circumferentially arranged protrusions and recesses, the recesses of the detent being arranged to engage with the protrusions of the first and second profiles, and the protrusions of the detent being arranged to engage with the recesses of the first and second profiles.

In some embodiments of the invention, the pivot mechanism is arranged such that it releasably secures the applicator head, or the roller applicator attachment, in an orientation substantially perpendicular to the elongate support, and in at least one orientation at an acute angle to the elongate support.

The flexible conduit may be arranged to flex to allow the applicator head (and the roller applicator attachment, if present) to adopt the plurality of discrete preset orientations with respect to the elongate support while maintaining the connection between the hollow interior of the elongate support and the applicator head.

The flexible conduit may be arranged such that it bypasses the pivot mechanism. The flexible conduit may be arranged such that it bypasses the pivot mechanism on an opposite side of the pivot mechanism to the acute angle that the applicator head or the roller applicator attachment may adopt with respect to the elongate support. This has been found to enable a compact and kink-free arrangement of the flexible conduit. For this reason, the applicator head or the roller applicator attachment may adopt an acute angle with respect to the elongate support in only one rotational direction (i.e. only to the left, or only to the right, of perpendicular).

A second aspect of the invention provides a paint applicator, comprising:

(a) an applicator head;

(b) a roller applicator attachment attached to the applicator head;

(c) a substantially rigid elongate support having a hollow interior for supplying paint to the applicator head;

(d) a pivot mechanism interconnecting the elongate support and the applicator head; and (e) a flexible conduit interconnecting the hollow interior of the elongate support and the applicator head;

wherein the pivot mechanism is arranged such that it releasably secures the roller applicator attachment in an orientation substantially perpendicular to the elongate support, and in at least one orientation at an acute angle to the elongate support, and wherein the flexible conduit is arranged such that it bypasses the pivot mechanism substantially on an opposite side of the pivot mechanism to said acute angle.

It is to be understood that any feature of any aspect of the invention may be a feature of any other aspect of the invention.

The paint applicator according to the invention may further comprises a plunger, at least part of which is located within the hollow substantially rigid elongate support and is arranged to push paint from the hollow substantially rigid elongate support to the applicator head via the flexible conduit. The hollow substantially rigid elongate support may be in the form of a cylinder. In use, paint is drawn into the elongate hollow support through an inlet part of the paint applicator, by the plunger being pulled backwards in a direction away from the elongate hollow support, in the manner of a syringe. The inlet part may comprise a protrusion, for example a generally cylindrical protrusion, protruding with respect to the remainder of the paint applicator.

Some embodiments of the invention may include a supply part for attachment to a paint container, through which paint may be supplied to the paint applicator via the inlet part. The inlet part and the supply part may be arranged to fit together such that paint may be drawn through them and into the hollow elongate support. The inlet part and/or the supply part may include an indicator arranged to indicate when they are fully fitted together for use.

The supply part may comprise a receptacle part arranged to receive at least a portion of the inlet part therein when the inlet part and the supply part are fitted together in use. The portion of the inlet part may comprise the indicator, and the portion may be arranged such that, in use, its receipt in the receptacle part indicates that the inlet part and the supply part are fully fitted together for use. For example, the receipt of the indicator in the receptacle such that the indicator is substantially hidden from view, may indicate that the inlet part and the supply part are fully fitted together for use. The portion of the inlet part may comprise a cap having an opening extending therethrough.

Additionally or alternatively, the supply part may comprise an insertion part, at least a portion of which is arranged to be inserted into the inlet part when the inlet part and the supply part are fitted together in use. The portion of the insertion part may comprise the indicator, and the portion may be arranged such that, in use, its insertion into the inlet part indicates that the inlet part and the supply part are fully fitted together for use. For example, the insertion of the indicator into the inlet part such that the indicator is substantially hidden from view, may indicate that the inlet part and the supply part are fully fitted together for use.

The indicator may be visibly distinctive in relation to the remainder of the inlet part and/or the supply part. For example, the indicator may be brightly coloured and/or may comprise distinctive markings.

In some embodiments of the invention, the supply part includes a clip for attaching the supply part to a paint container. For example, the clip may be attached to, or may be part of, the receptacle part (if present).

Additionally or alternatively, the supply part may include a lid for attaching the supply part to a paint container and substantially closing the paint container. For example, the receptacle part may be attached to, or may be part of, the lid (if present).

The insertion part may be arranged to extend through the receptacle part. The insertion part and the receptacle part may be separate parts that are arranged to be connected together for use.

In some embodiments, the paint applicator according to the invention further comprises a stand for supporting the paint applicator on a horizontal surface, the stand may be arranged such that the applicator head is thereby spaced apart from the horizontal surface. At least part of the stand may be movable (e.g. rotatable) with respect to the remainder of the paint applicator, between an operational position in which it is arranged to provide support for the paint applicator, and a non-operational position.

At least part of the stand, in a said non-operational position, is located adjacent to the flexible conduit and/or the substantially rigid elongate support. The stand may be pivotably mounted to a part of the paint applicator.

The applicator head, the pivot mechanism and the flexible conduit together may comprise a sub-assembly that is releasably connected to the substantially rigid elongate support.

A third aspect of the invention provides a paint applicator, comprising:

(a) a hollow applicator head assembly for carrying an applicator attachment and for supplying paint thereto; and (b) a substantially rigid elongate support attached to the applicator head assembly, comprising a hollow cylinder for holding paint, and a plunger, at least part of which is located within the hollow cylinder and arranged to push paint from the cylinder and into the applicator head;

wherein the applicator head assembly includes a closable aperture through which paint may be drawn into the cylinder, and the applicator head assembly and the cylinder include interconnecting parts by which the applicator head assembly is releasably attachable to the cylinder.

The third aspect of the invention has an advantage in that making the elongate hollow support removable from the applicator head assembly can enable the applicator head assembly and the front end (piston part) of the plunger to be cleaned more easily after use.

In some embodiments of the invention, the interconnecting parts by which the applicator head assembly is releasably attachable to the cylinder comprise a screw thread on the applicator head assembly or the cylinder, and a screw threaded rotatable collar on the cylinder or the applicator head assembly, respectively. A retaining part may be provided on an end region of the cylinder or the applicator head assembly, to retain the screw threaded rotatable collar thereon such that when the two screw threads are screwed together the cylinder and the applicator head assembly are securely attached to each other. The retaining part may be attached to the cylinder or the applicator head assembly by a solvent weld. The retaining part may comprise a flange part.

BRIEF DESCRIPTION OF THE DRAWINGS

Embodiments of the invention will now be described, by way of example, with reference to the accompanying drawings, of which.

DETAILED DESCRIPTION OF THE DRAWINGS

Figure 1:
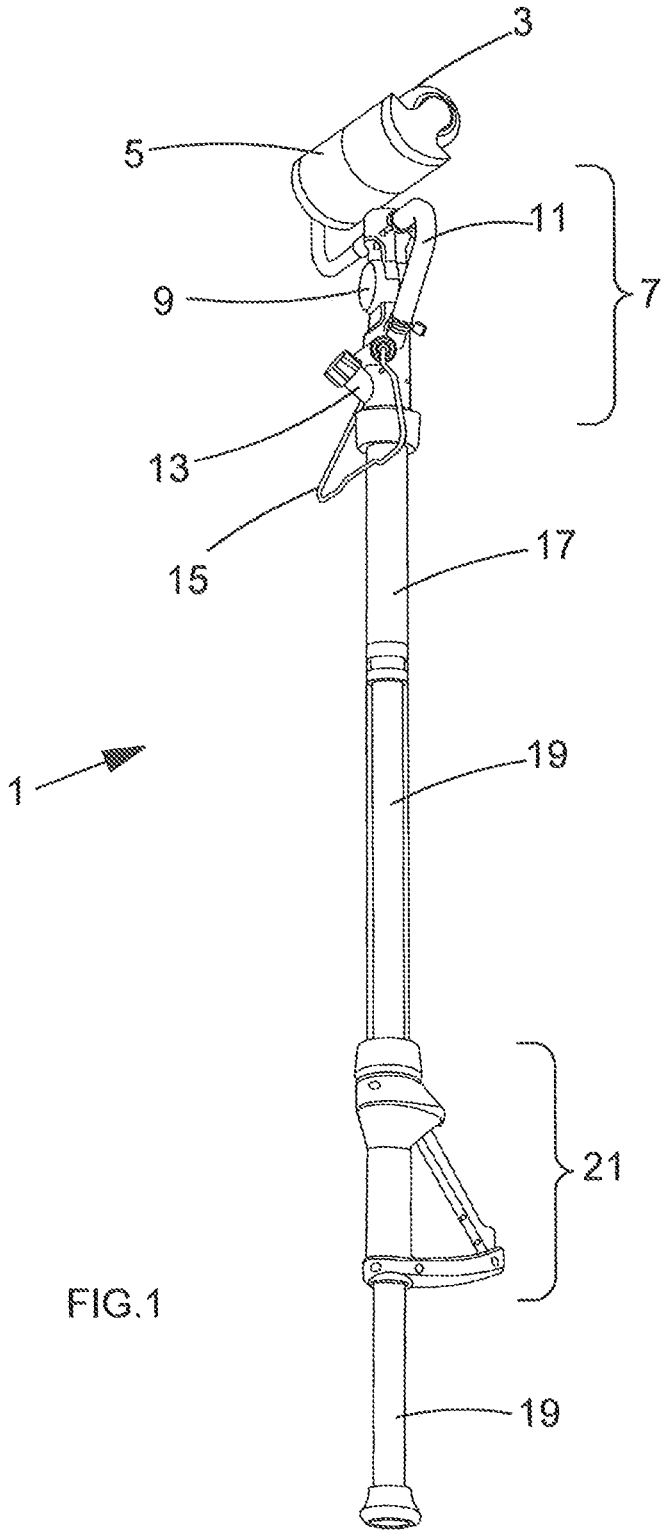
FIG. 1 shows an embodiment of a paint applicator according to the invention.

FIG. 1 shows an embodiment of a paint applicator 1 according to the invention. The paint applicator 1 comprises: an applicator attachment 3 comprising a roller applicator attachment; a paint guard 5; an applicator head assembly 7, which carries the applicator attachment 3 and the paint guard 5, and which includes a pivot mechanism 9, a flexible conduit 11, a paint inlet part 13, and a movable stand 15; a substantially rigid elongate cylinder 17 connected to the applicator head assembly 7; a plunger 19 partially located within the cylinder 17, and a plunger feed assembly 21 for moving the plunger towards the applicator head assembly 7.

Figure 2:
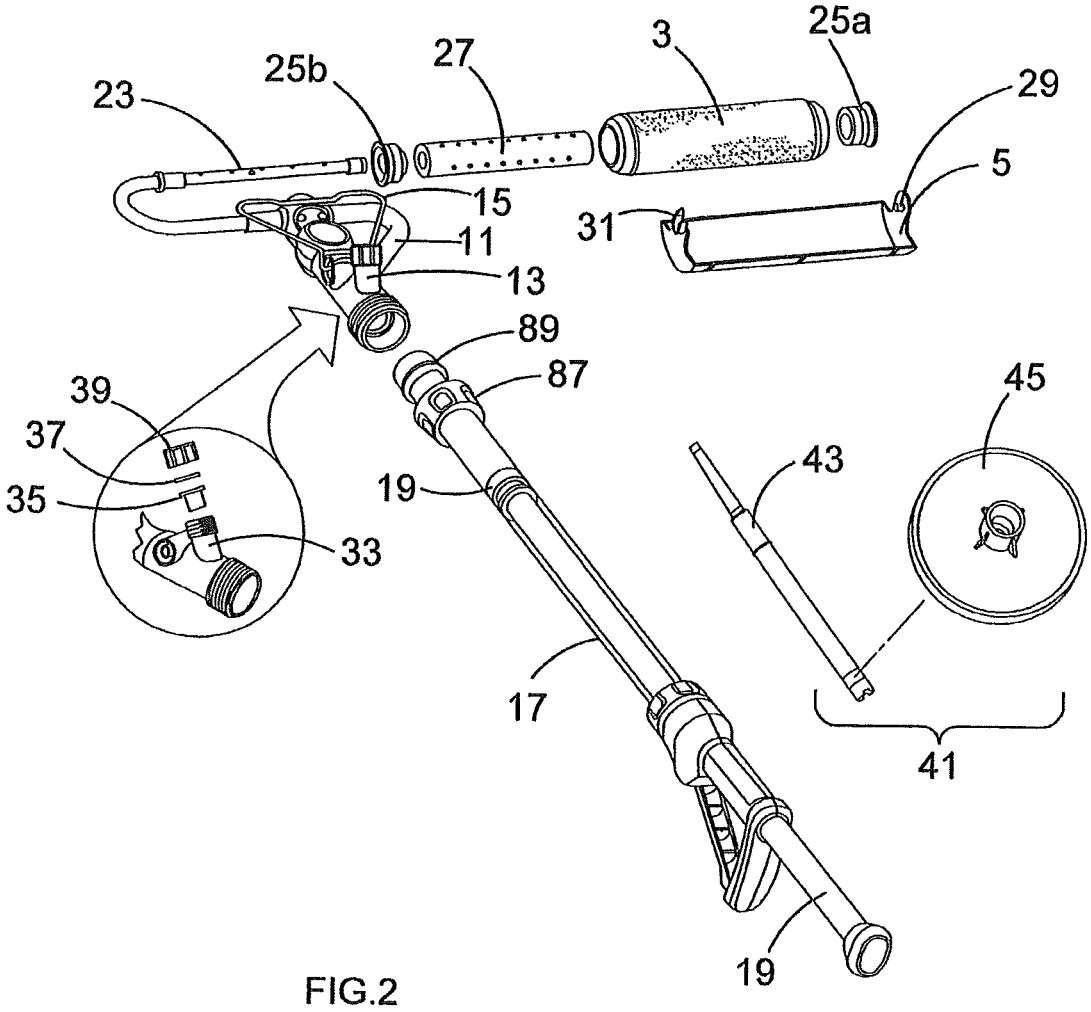
FIG. 2 is a partially exploded drawing of the paint applicator shown in FIG. 1, with two additional parts also shown.

FIG. 2 shows some further detail of the paint applicator shown in FIG. 1. The applicator head assembly 7 includes an applicator head 23 in the form of a hollow cylindrical support to which the roller applicator attachment 3 may be rotatably attached via end caps 25*a* and 25*b* rotatably mounted on the hollow cylindrical support 23. A perforated intermediate cylindrical part 27 may also be located between the hollow cylindrical support 23 and the roller applicator attachment 3. The paint guard 5 is removably attachable to the applicator head assembly 7 by a protrusion 29 at one end of the paint guard locating in a recess in end cap 25*a* and a flexible forked part 31 at an opposite end of the paint guard locating around part of the hollow cylindrical support 23.

Also shown in FIG. 2 is an exploded detail of the paint inlet part 13, which comprises a hollow protrusion 33 extending from the applicator head assembly 7, and a valve member 35 located in the hollow protrusion. The valve member 35 and a flexible perforated barrier part 37 are retained in/on the hollow protrusion 33 by a threaded cap 39 which has an opening extending therethrough. Additionally, FIG. 2 shows two components of an embodiment of a paint supply part 41 for attachment to a paint container (not shown in FIG. 2). The paint supply part 41 comprises: a hollow elongate insertion part 43, part of which is arranged to be inserted into the paint inlet part 13 to supply paint to the paint applicator 1; and an attachment part 45 for attachment to a paint container and for supporting the insertion part 43. In use, paint may be drawn into the elongate cylinder 17 through the insertion part 43 and the inlet part 13, by the plunger being pulled backwards in a direction away from the cylinder 17, in the manner of a syringe. This is described in greater detail below.

Figure 3:
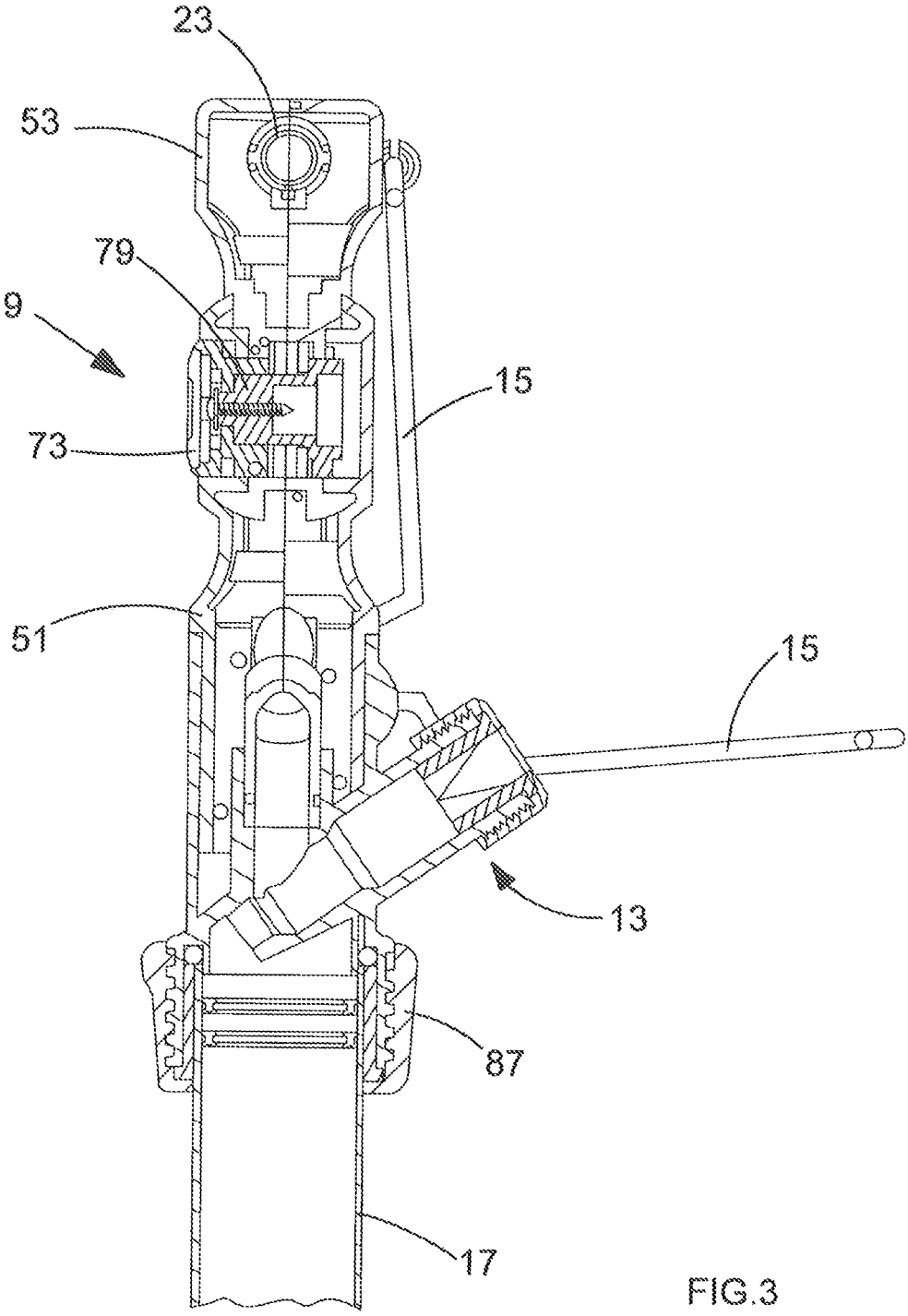
FIG. 3 is a sectional illustration of part of the paint applicator of FIGS. 1 and 2.

FIG. 3 shows, in longitudinal cross-section, part of the paint applicator of FIGS. 1 and 2. In particular, the figure shows the pivot mechanism 9 which interconnects the substantially rigid elongate cylinder 17 and the applicator head 23, and it also shows the paint inlet part 13, the movable stand 15 (shown in two different positions), and the interconnecting parts by which the applicator head assembly 7 is releasably attachable to the cylinder 17. The pivot mechanism is also shown in longitudinal cross-section in FIG. 4. Additionally, FIG. 5 shows in exploded form the main parts of an almost identical pivot mechanism 9, from which the construction and functioning of the pivot mechanism can perhaps be more easily understood.

The pivot mechanism 9 comprises a first profile 47 and a corresponding second profile 49. The first profile 47 is on a first part 51 of the applicator head assembly 7 which connects with the substantially rigid elongate cylinder 17, and the second profile 49 is on a second part 53 of the applicator head assembly 7 which carries the applicator head 23. Thus, rotation of the first and second parts 51 and 53 of the applicator head assembly 7 with respect to each other results in a rotation (or pivoting) of the applicator head with respect to the substantially rigid elongate cylinder 17. The first and second profiles 47 and 49 each comprise a plurality of protrusions 55 and recesses 57 circumferentially and radially inwardly arranged around the axis of rotation of the first and second parts 51 and 53. The first and second profiles 47 and 49 are substantially identical to each other, such that their respective protrusions 55 and their respective recesses 57 may be substantially aligned. A detent 59 comprises a part arranged to be located inside the first and second profiles 47 and 49 and to engage with both of the first and second profiles to prevent their rotation with respect to each other. The detent has a profile 60 comprising a plurality of protrusions 61 and recesses 63 circumferentially and radially outwardly arranged around the axis of rotation, the recesses 63 of the detent being arranged to engage with the protrusions 55 of the first and second profiles, and the protrusions 61 of the detent being arranged to engage with the recesses 57 of the first and second profiles.

Figure 6:
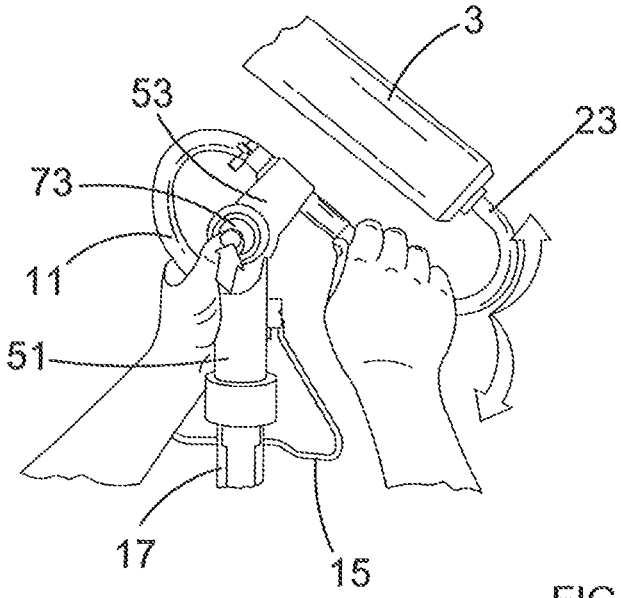
FIG. 6 is a schematic drawing showing use of the pivot mechanism of the paint applicator of FIGS. 1 to 4.

The detent 59 is resiliently biased by means of a compression spring 65 (which itself is retained between washers 67 and 69) such that its profile 60 is normally engaged with both of the profiles 47 and 49 of the first and second parts 51 and 53, to prevent their relative rotation. In order to allow the first and second parts 51 and 53 to rotate relative to each other, and thus to allow the rotation of the applicator head 23 with respect to the elongate cylinder 17, the detent 59 must be pushed axially by the user against the resilient bias of the compression spring 65 (i.e. downwardly against the upper washer 67 as drawn in FIG. 5), until the profile 60 of the detent is no longer in engagement with the first profile 47 but is still in engagement with the second profile 49. When this action is performed, a relatively narrow (in the radial direction) cylindrical region 71 of the detent 59 will, be level with the first profile 47. The user achieves this, as shown in FIG. 6, by pushing down on a cap 73 which is attached by tabs 75 to the detent 59. The user then begins to turn the applicator head 23 (also as shown in FIG. 6) while still pushing down on the cap 73, but once the applicator head has been turned slightly, the cap 73 may be released by the user. Once the first profile 47 has been rotated relative to the second profile 49 sufficiently for their respective protrusions 55 and their respective recesses 57 to be substantially aligned with each other once more the detent 59 will then return (in an upwards direction as drawn in FIG. 5) under the action of the compression spring 65 so that it is again engaged with both the first and second profiles 47 and 49. In this way, the applicator head is secured in a different preset orientation with respect to the elongate support, the preset orientations being determined by the arrangement of protrusions and recesses of the first and second profiles 47 and 49 and the detent 59.

Figure 4:
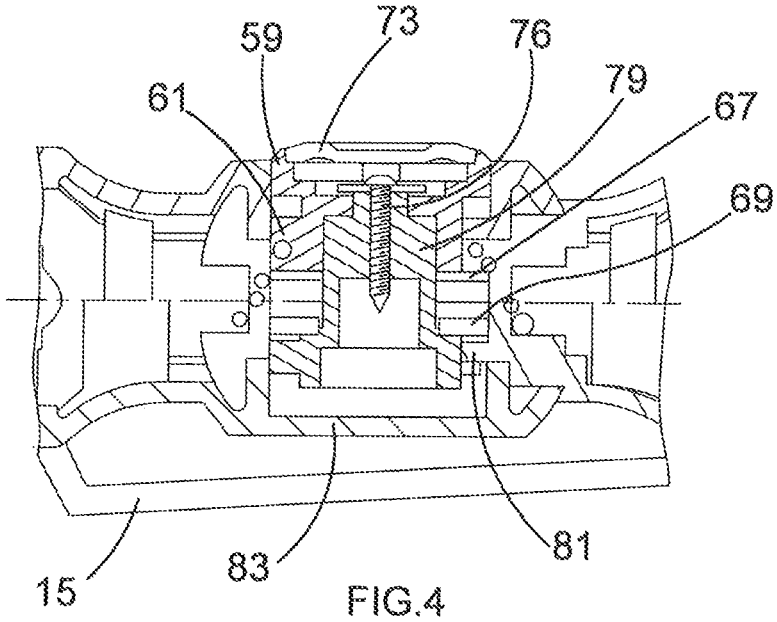
FIG. 4 shows a sectional detail of a pivot mechanism of the paint applicator of FIG. 3.
Figure 5:
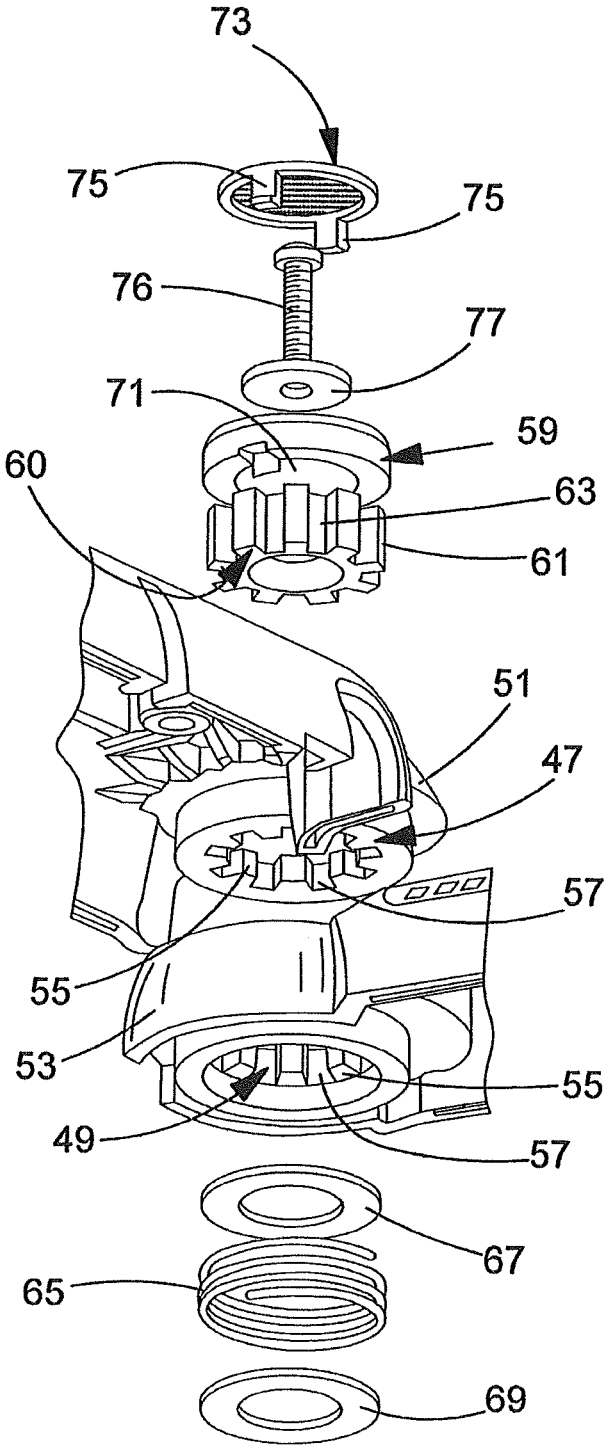
FIG. 5 is an exploded drawing of the main parts of a pivot mechanism similar to that shown in FIGS. 3 and 4.

Underneath the cap 73, the detent is retained in its normal resiliently biased position (in engagement with both first and second profiles 47 and 49) by means of a screw threaded fastener 76 and an associated washer 77 (which may alternatively be a single part) which are secured to an axially central part 79 (not shown in FIG. 5, but shown in FIGS. 3 and 4). The lower washer 69 is retained against a ledge 81 (against which it is pressed by the compression spring 65), not shown in FIG. 5 but shown in FIGS. 3 and 4. The underside of the pivot mechanism 9 is enclosed by a casing part 83.

Figure 7:
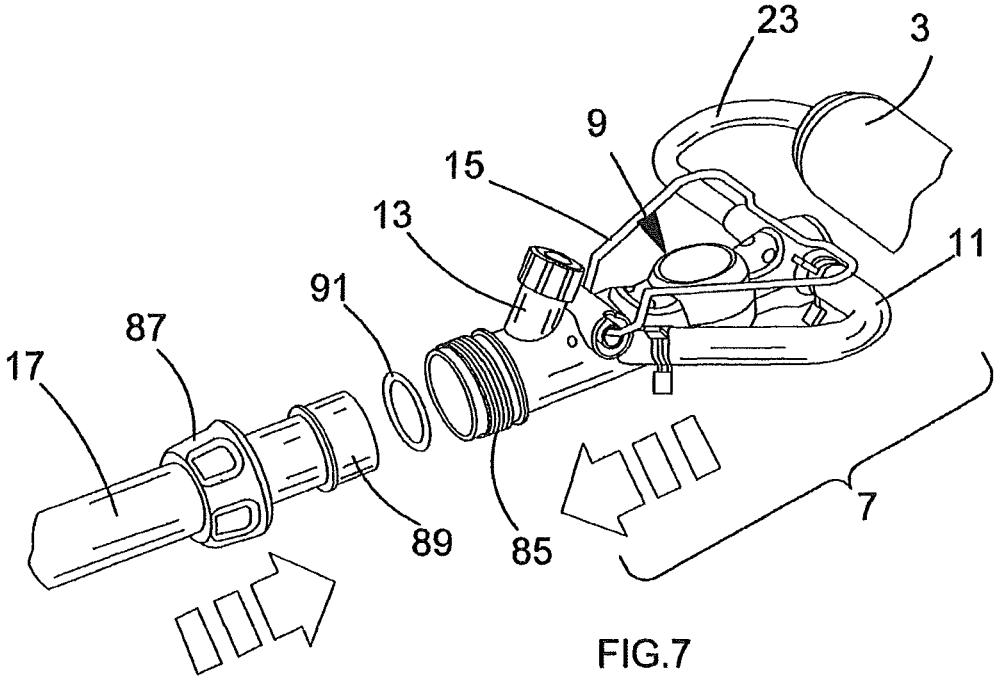
FIG. 7 is an illustration of part of the paint applicator shown in FIGS. 1 to 4, showing an applicator head assembly separated from a cylinder of the paint applicator.

FIG. 7 illustrates part of the paint applicator shown in FIGS. 1 to 4, showing the applicator head assembly 7 separated from the cylinder 17 of the paint applicator 1. The applicator head assembly 7 is releasably attachable to the cylinder 17 by a male screw thread 85 on the applicator head assembly which is engageable with a female screw thread located on the inside of a rotatable collar 87 provided on the cylinder 17. (Alternatively, the male screw thread could be provided on the cylinder and the screw threaded rotatable collar could be provided on the applicator head assembly 7.) A retaining part 89 in the form of a flange part is solvent welded to the end region of the cylinder 17, to retain the rotatable collar 87 on the cylinder such that when the two screw threads are screwed together the cylinder and the applicator head assembly 7 are securely attached to each other. An O-ring seal 91 may be provided between the cylinder 17 and the applicator head assembly 7.

Figure 9A:
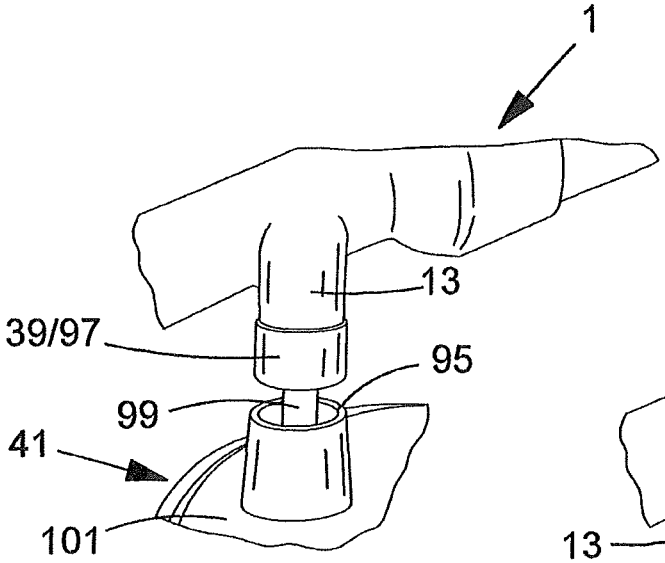
FIGS. 9(*a*) and 9(*b*) are schematic illustrations also showing the fitting together of a paint inlet part of a paint applicator with a paint supply part attached to a paint container.
Figure 9B:
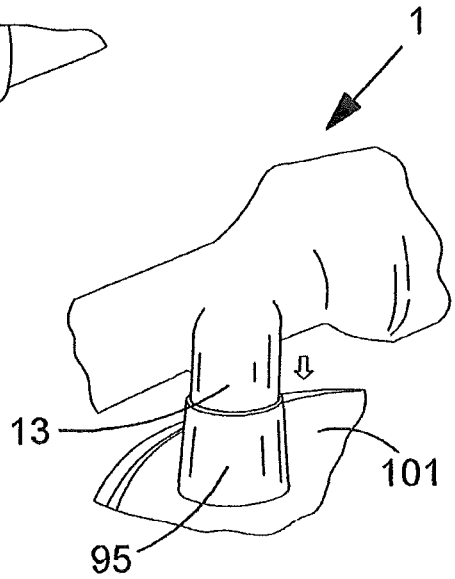
Figure 8A:
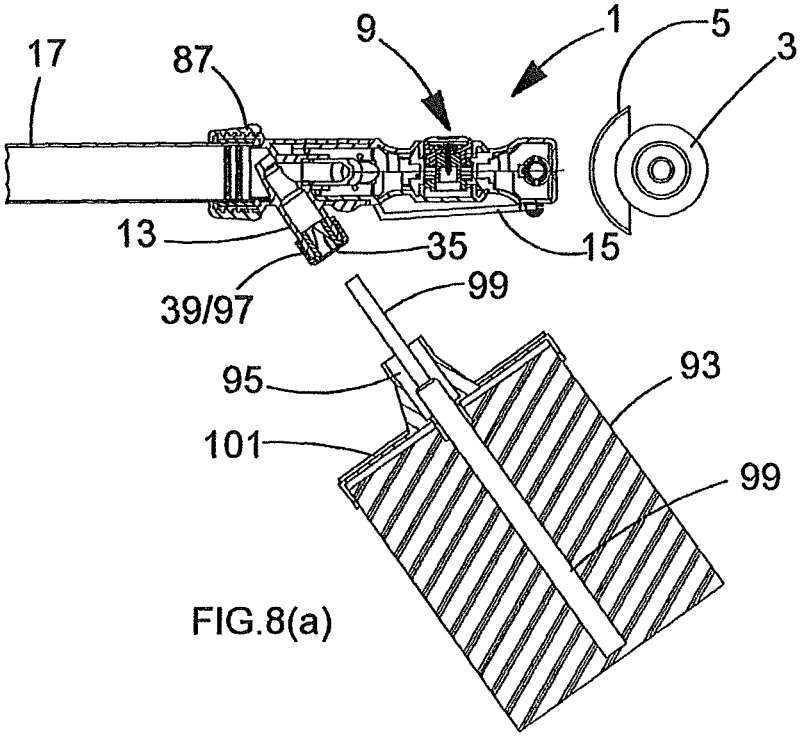
FIGS. 8(*a*) and 8(*b*) show the fitting together of a paint inlet part of the paint applicator of FIGS. 1 to 4, with a paint supply part attached to a paint container.
Figure 8B:
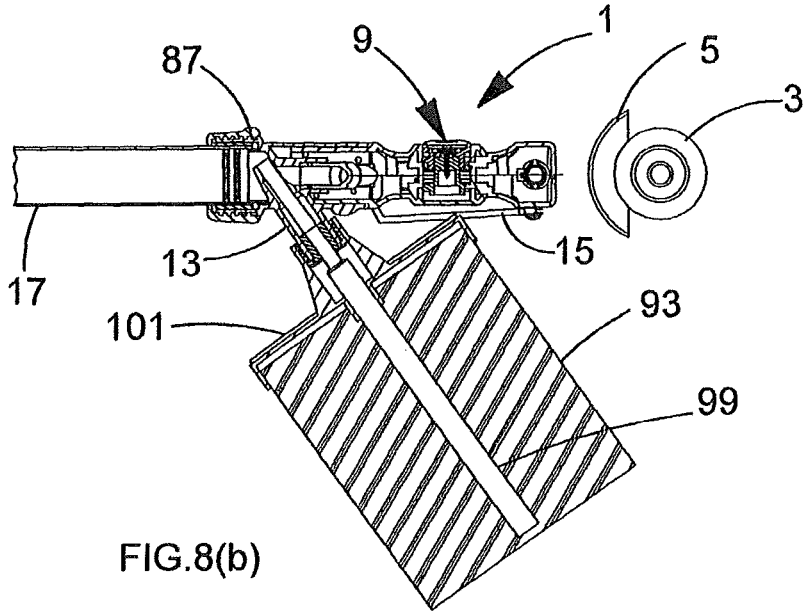

FIGS. 8 and 9 show the fitting together of the paint inlet part 13 of the paint applicator of FIGS. 1 to 4, with the paint supply part 41 attached to a paint container 93. The inlet part 13 comprises a generally cylindrical protrusion, protruding with respect to the remainder of the paint applicator. The supply part 41 comprises a receptacle part 95 arranged to receive a portion of the inlet part 13 therein when the inlet part and the supply part are fitted together in use. The supply part 41 also includes an insertion part 99, at least a portion of which is arranged to be inserted into the inlet part 13 such that it extends through both the flexible perforated barrier part 37 and the valve member 35 when the inlet part and the supply part are fully fitted together in use. The portion of the inlet part 13 received in the receptacle part 95 comprises the indicator 97. The indicator 97 is visibly distinctive in relation to the remainder of the inlet part 13, and in the present embodiment the indicator 97 comprises a coloured cap 39 having an opening extending therethrough. The indicator 97 may be brightly coloured, e.g. it may be coloured red or some other easily visible colour, and/or it may carry one or more easily visible markings, for example. The indicator 97 is arranged such that, in use, its receipt in the receptacle part 95 indicates to the user that the inlet part and the supply part are fully fitted together. In particular, the receipt of the indicator 97 in the receptacle part 95 is such that the indicator is substantially hidden from view, and this indicates that the inlet part and the supply part are fully fitted together for use. This is important because in order to draw paint from the container 93 into the substantially rigid elongate support 17, it is necessary to have a tight connection between the paint inlet part 13 and the paint supply part 41, i.e. with the insertion part 99 extending through the valve member 35. The valve member 35 comprises a flexible elastomeric part having a slit which the insertion part 99 opens and extends through when the insertion part is fully inserted into the inlet part 13.

Figure 10A:
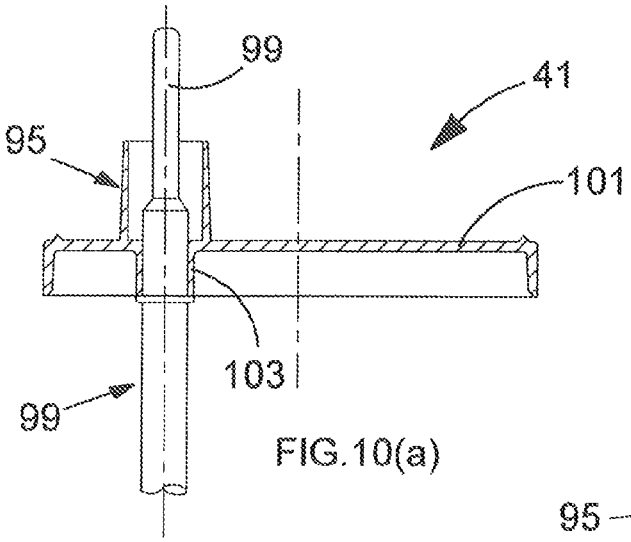
FIGS. 10(*a*), 10(*b*) and 10(*c*) are sectional views showing three embodiments of paint supply part for attachment to a paint container.
Figure 10B:
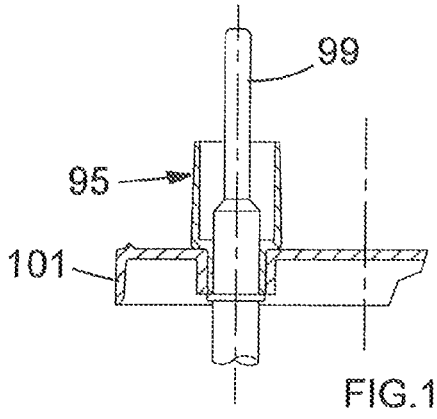
Figure 10C:
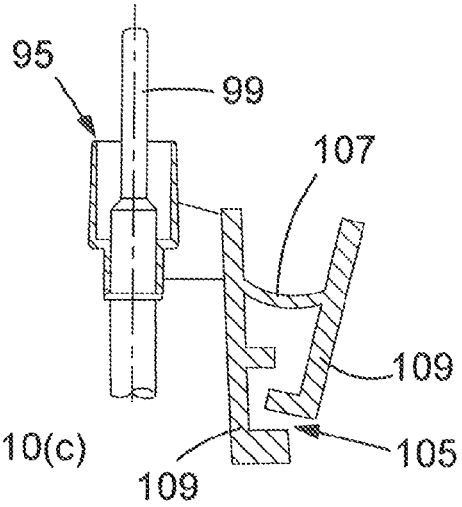

The supply part 41 shown in FIGS. 8, 9, 10(*a*) and 10(*b*), includes a lid 101 for attaching the supply part to the paint container 93 and substantially closing the paint container. In particular, the insertion part 99 is received as an interference-fit in a cylindrical protrusion 103 projecting from the underside of the lid 101. The insertion part 99 also extends through the receptacle part 95, which is a larger cylindrical protrusion extending from the upper side of the lid 101. The lid 101 may be integral with the receptacle part 95 as shown in FIG. 10(*a*), or the lid may be a separate part from the receptacle part as shown in FIG. 10(*b*).

Alternatively, as shown in FIG. 10(*c*), the supply part 41 may include a clip 105 for attaching the supply part to the paint container 93. As shown, the clip 105 extends from the receptacle part 95. The clip 105 includes a flexible part 107 to allow the user to open two legs 109 of the clip to attach it to, and remove it from, the side wall of the paint container 93.

Figure 11:
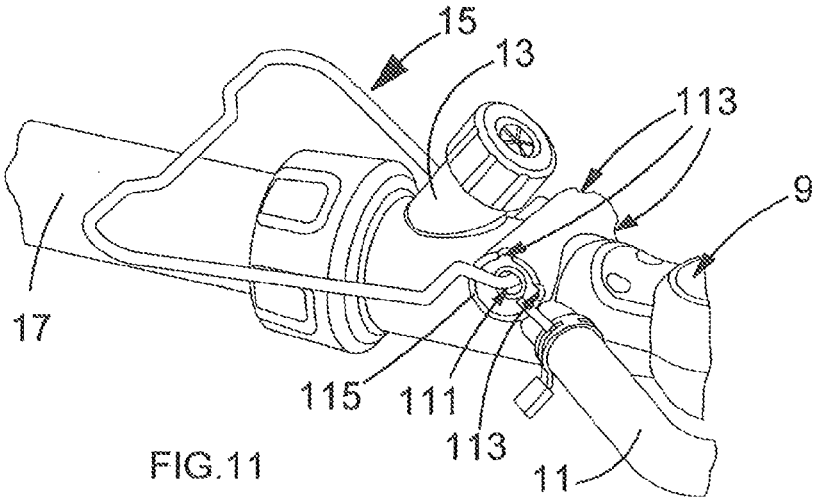
FIG. 11 is an illustration of part of the paint applicator of FIGS. 1 to 4, showing, in particular, a movable stand of the paint applicator.

FIG. 11 shows part of the paint applicator of FIGS. 1 to 4, illustrating, in particular, the stand 15 of the paint applicator 1. The stand 15 is formed from resiliently flexible metal wire, and is pivotably mounted to the applicator head assembly 7. The applicator head assembly 7 is provided with a pair of openings 111 on opposite sides thereof, and each opposite end of the metal wire part which forms the stand 15 is located in a respective opening.

Figure 12:
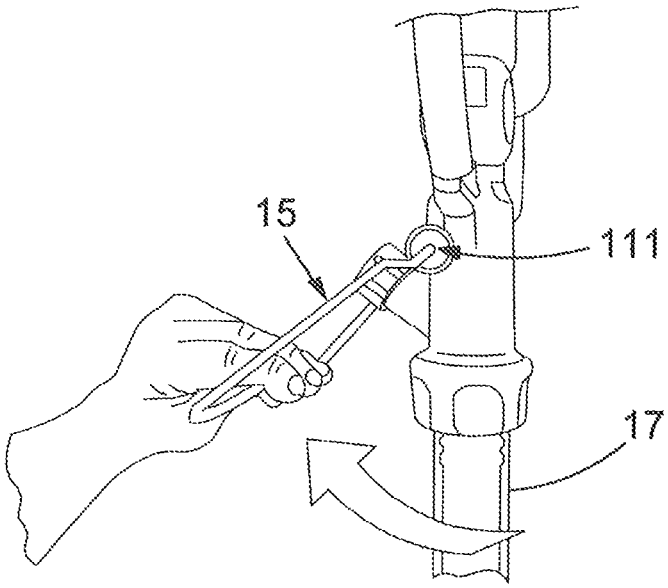
FIG. 12 is a schematic illustration showing the movable stand being moved by a user.

Located adjacent to each opening 111 is a plurality (three, in the embodiment shown) of recesses 113. The recesses 113 are provided in a surface 115 oriented substantially perpendicular to the axis of rotation A-A of the stand 15. The axis of rotation A-A of the stand 15 is substantially perpendicular to the pivot axis P-P of the pivot mechanism 9 (see FIG. 13). The stand 15, the recesses 113, and the surface 115 are arranged such that the recesses 113 act as detent positions for the stand 15, whereby rotating the stand (for example as shown in FIG. 12) out of any of the recesses 113 entails a resilient flexing of the metal wire of the stand, which resilient flexing is relieved only when the stand once again locates in a recess 113.

The recesses 113 are arranged to provide two non-operational positions for the stand 15, in which the stand lies adjacent to (e.g. substantially flush with, or substantially parallel to) the main body of the paint applicator (i.e. the cylinder 17 and the applicator head assembly 7). FIGS. 1, 6 and 11 show the stand 15 in a non-operational in which it is located adjacent to the cylinder 17. FIGS. 2 and 7 shows the stand 15 in a non-operational position, in which it is located adjacent to the flexible conduit 11. In the latter non-operational position, the stand may provide a degree of protection to the flexible conduit 11.

Figure 13:
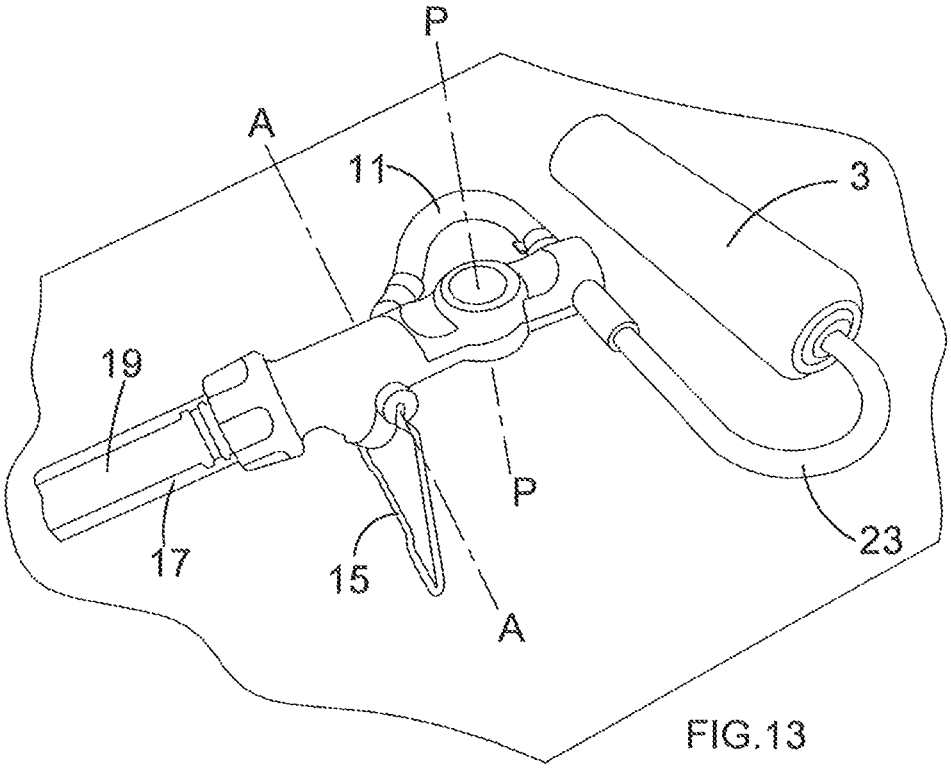
FIG. 13 is a schematic illustration showing the stand in use in an operational position.

The recesses 113 are also arranged to provide an operational position for the stand 15, in which the stand projects from the main body of the paint applicator 1, e.g. in a direction substantially perpendicular to the axis of the cylinder 17, as shown in FIG. 13. The stand 15 consequently is arranged such that the applicator head 23 (and the applicator attachment 3) is spaced apart from a flat horizontal surface (e.g. the ground, or a floor) on which the paint applicator 1 is placed, with the stand in its operational position, as shown in FIG. 13.

Figure 14A:
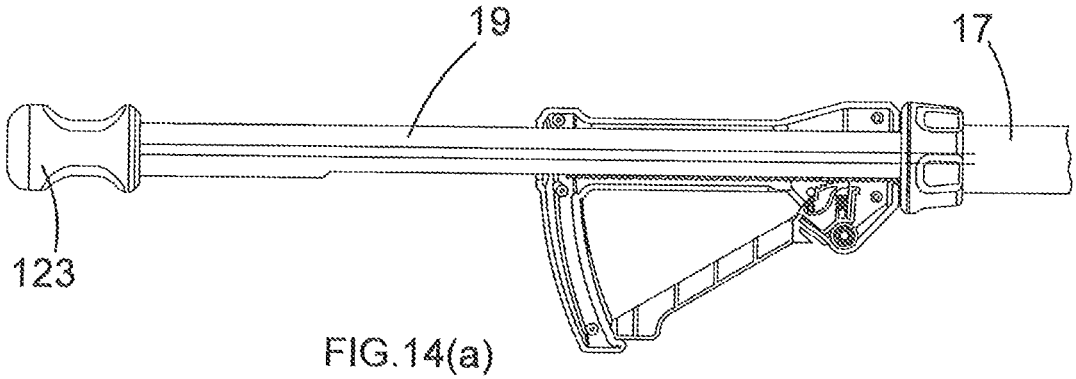
FIGS. 14(*a*) and 14(*b*) are part sectional illustrations showing a ratcheting feed mechanism of a plunger of the paint applicator of FIGS. 1 to 4.
Figure 14B:
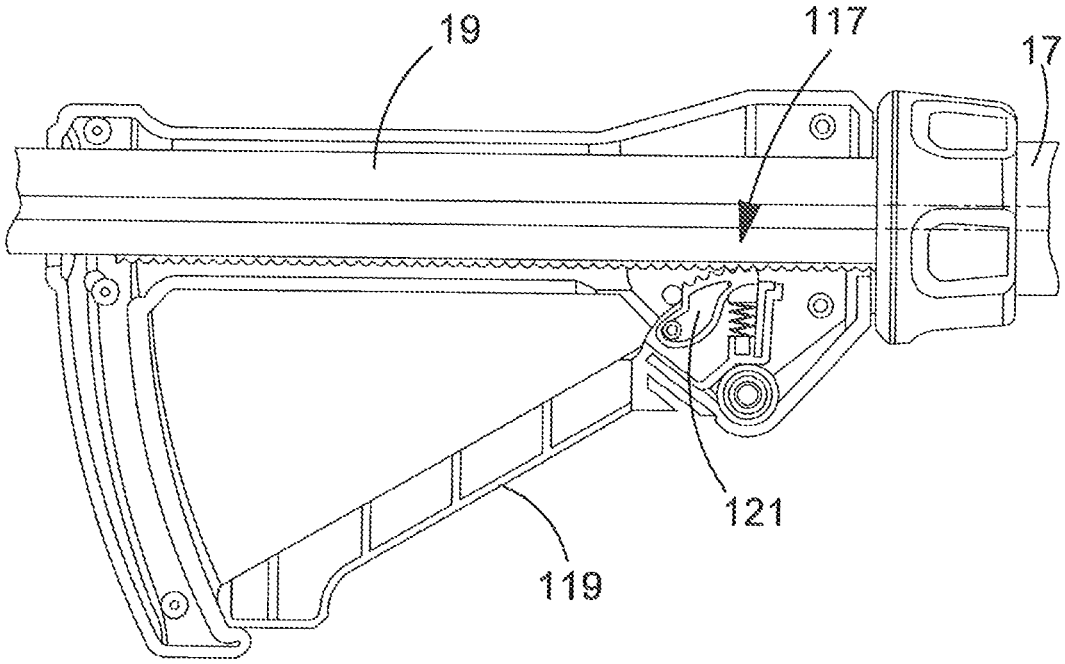

FIGS. 14(*a*) and 14(*b*) are part sectional illustrations showing a ratcheting feed mechanism 117 for the plunger 19 of the paint applicator 1 of FIGS. 1 to 4. The ratcheting feed mechanism 117 includes a spring-biased pivoting handle 119 and a spring-biased ratchet pawl 121, by which the plunger may be incrementally pushed towards the applicator head 23 to force paint from the cylinder 17 to the applicator attachment 3, in use. The spring-biased ratchet pawl 121 also permits the plunger 19 to be pulled back (using a handle 123 at the rear end of the plunger) in a direction away from the applicator head 23, to draw paint into the cylinder 17 through the inlet part 13.

Although exemplary embodiments of the present invention have been shown and described, it will be appreciated by those skilled in the art that changes may be made to these embodiments without departing from the principles and spirit of the invention, the scope of which is defined in the appended claims and their equivalents

The invention claimed is:

1. A paint applicator, comprising:

(a) an applicator head for carrying an applicator attachment;

(b) a substantially rigid elongate support having a hollow interior for supplying paint to the applicator head;

(c) a pivot mechanism interconnecting the elongate support and the applicator head; and (d) a flexible conduit interconnecting the hollow interior of the elongate support and the applicator head;

wherein the pivot mechanism includes a detent arranged such that it releasably secures the applicator head in any of a plurality of discrete preset orientations with respect to the elongate support;

wherein the plurality of discrete preset orientations comprise at least one orientation substantially perpendicular to the elongate support and at least one orientation at an acute angle to the elongate support;

wherein the applicator head may be rotated in a first direction from the orientation substantially perpendicular to the elongate support to the at least one orientation at an acute angle to the elongate support; and wherein the applicator head cannot be rotated from the orientation substantially perpendicular to the elongate support in a second direction, opposite the first direction, to another discrete preset orientation.

2. A paint applicator according to claim 1, wherein the pivot mechanism comprises first and second corresponding profiles, and the detent comprises a profile arranged to engage with both the first and second profiles to prevent their rotation with respect to each other, thereby securing the applicator head in a said discrete preset orientation with respect to the elongate support.

3. A paint applicator according to claim 2, wherein the detent is arranged to allow the applicator head to be released from said discrete preset orientation with respect to the elongate support by being movable out of engagement with at least one of the first and second profiles.

4. A paint applicator according to claim 3, wherein the detent is resiliently biased to engage with both the first and second profiles.

5. A paint applicator according to claim 4, wherein the first and second profiles each comprise a plurality of circumferentially arranged protrusions and recesses, and wherein the discrete preset orientations correspond to relative orientations of the first and second profiles wherein their respective protrusions and their respective recesses are substantially aligned.

6. A paint applicator according to claim 5, wherein the detent comprises a plurality of circumferentially arranged protrusions and recesses, the recesses of the detent being arranged to engage with the protrusions of the first and second profiles, and the protrusions of the detent being arranged to engage with the recesses of the first and second profiles.

7. A paint applicator according to claim 1, wherein the applicator head comprises a hollow perforated cylindrical support for an applicator attachment in the form of a roller applicator attachment.

8. A paint applicator according claim 7, wherein the paint applicator includes the applicator attachment and the applicator attachment is a roller applicator attachment.

9. A paint applicator according to claim 8, wherein the flexible conduit is arranged such that it bypasses the pivot mechanism.

10. A paint applicator according to claim 9, wherein the flexible conduit is arranged such that it bypasses the pivot mechanism on an opposite side of the pivot mechanism to said acute angle.

11. A paint applicator according to claim 1, wherein the flexible conduit is arranged to flex to allow the applicator head to adopt the plurality of discrete preset orientations with respect to the elongate support while maintaining the connection between the hollow interior of the elongate support and the applicator head.

12. A paint applicator, comprising:

(a) an applicator head;

(b) a roller applicator attachment having a longitudinal axis and being attached to the applicator head;

(c) a substantially rigid elongate support having a hollow interior for supplying paint to the applicator head;

(d) a pivot mechanism interconnecting the elongate support and the applicator head; and (e) a flexible conduit interconnecting the hollow interior of the elongate support and the applicator head;

wherein the pivot mechanism is arranged such that it releasably secures the roller applicator attachment in an orientation such that the longitudinal axis of the roller applicator attachment is substantially perpendicular to the elongate support, and in at least one orientation such that the longitudinal axis of the roller applicator attachment is at an acute angle to the elongate support;

wherein the roller applicator attachment is configured to rotate about an axis perpendicular to both the substantially rigid elongate support and the longitudinal axis of the roller applicator attachment.

13. A paint applicator according to claim 12, further comprising a plunger, at least part of which is located within the hollow substantially rigid elongate support and is arranged to push paint from the hollow substantially rigid elongate support to the applicator head via the flexible conduit.

14. A paint applicator according to claim 12, further comprising a stand for supporting the paint applicator on a horizontal surface and arranged such that the applicator head is thereby spaced apart from the horizontal surface.

15. A paint applicator according to claim 14, wherein at least part of the stand is movable with respect to the remainder of the paint applicator, between an operational position wherein it is arranged to provide said support for the paint applicator, and a non-operational position.

16. A paint applicator according to claim 15, wherein at least part of the stand, in a said non-operational position, is located adjacent to at least one of the flexible conduit and the substantially rigid elongate support.

17. A paint applicator according to claim 15, wherein the stand is pivotably mounted to a part of the paint applicator.

18. A paint applicator according to claim 12, wherein the applicator head, the pivot mechanism and the flexible conduit together comprise a sub-assembly that is releasably connected to the substantially rigid elongate support.

* * * * *